US006213329B1

(12) United States Patent
Dobson

(10) Patent No.: US 6,213,329 B1
(45) **Date of Patent: *Apr. 10, 2001**

(54) CONTAINER LID

(76) Inventor: Mark Dobson, 18 Timothy Road, Morphett Vale (AU), 5162

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/136,066

(22) Filed: Aug. 19, 1998

(30) Foreign Application Priority Data

Sep. 1, 1997 (AU) ..... PO8887

(51) Int. Cl.[7] ..... B65D 43/03; B65D 43/06

(52) U.S. Cl. ..... 220/212; 206/15.2; 206/15.3; 206/361; 206/519; 220/380; 220/736; 220/781

(58) Field of Search ..... 220/212, 212.5, 220/697, 729, 735, 736, 571.1, 572, 781, 780, 380, 699, 700, 701, 731, 733; 206/229, 1.9, 361, 362, 15.2, 15.3, 508, 519, 520; 15/146, 257.07

(56) References Cited

U.S. PATENT DOCUMENTS 1,834,085 * 12/1931 Bloom ..... 220/735
1,896,463 * 2/1933 Offerman ..... 220/212.5
2,627,276 * 2/1953 Eggleton ..... 220/735
2,654,504 * 10/1953 Hyams ..... 220/736
3,085,583 * 4/1963 Siek ..... 220/735
4,360,119 * 11/1982 Olivo ..... 220/212.5
4,865,188 9/1989 Custeau .
5,316,399 * 5/1994 Joulia ..... 220/212.5
5,489,042 * 2/1996 Ewald ..... 220/735
5,683,009 * 11/1997 King ..... 220/697 X
5,806,704 * 9/1998 Jamison ..... 220/736
5,992,617 * 11/1999 Couch et al. ..... 220/736 X

FOREIGN PATENT DOCUMENTS 92 00055 1/1992 (NL) .

* cited by examiner

*Primary Examiner*—Allan N. Shoap
*Assistant Examiner*—Niki M. Eloshway
(74) *Attorney, Agent, or Firm*—APT Patent Attorneys

(57) ABSTRACT

A container lid including for holding a painting implement suspended above or in a liquid such as paint. The container lid includes a container engaging periphery for engaging the periphery of the container. A lid web extends between the container engaging periphery and an handle receiving aperture which passes through the lid web. The handle of the painting implement is gripped from above the handle receiving aperture. The handle of the painting implement is gripped between two opposed walls extending upwardly of the lid web which are held in a substantially fixed position relative to one another by sides, the opposed walls are spaced apart to an extent that they exert a clamping effect on the handle of the painting implement when inserted therebetween.

6 Claims, 5 Drawing Sheets

CONTAINER LID

FIELD OF THE INVENTION

This invention relates to the storage of painting implements between uses, and a specific form relates to the storage of paint brushes.

BACKGROUND

It is general practice when painting to clean paint brushes between uses, otherwise paint hardens on the brush and spoils the brush. Additionally it is quite important that the brushes be cleaned very thoroughly, otherwise the useful length of the bristles shortens considerably over time as a result of the build up of paint at the base of the bristles, rendering the paint brush in a progressively poorer condition and resulting in a reduced life of the brush.

Thoroughly cleaning a brush or other painting implement is a time consuming and tedious practice and frustrating where a brush is used for only a short while. Consequently the practice is often not performed satisfactorily.

Cleaning brushes can also be wasteful and polluting, often resulting in compounds that are relatively toxic, such as acrylics, from water based paints ending up in waterways. In the case of solvent based paints the use of solvents for the requisite multiple rinses of the brush is also undesirable because there is the additional problem of the disposal of solvents as well as the expense of purchasing the solvent.

In painting practice using water based paints, it is common to suspend brushes in a water bath keeping the handle free. This practice is unsatisfactory because water soaks into the brush and up the bristles so that when reused, despite vigorous efforts to dry the brush, a paint/water mixture will run down the upturned handle onto the hand of the user.

Additionally where the paint brush is to be transported such as will be the case with a tradesman, it is exceedingly difficult not to have the entire brush fall into the container when travelling between work sites.

It is also not adequate to have the brush sit in a rack that is located at the bottom of the paint container, or a container with water, because the bristles will assume a curved position as a result of resting on the base of the container, which will impact on the usefulness of the brush. Additionally the handle of the brush may be covered at least in part by paint which detracts from the usefulness of such a practice. There is a need for free access to paint within the container so that the suggestion of a rack in the paint container itself is not an effective solution to the problem because access to paint within the container will at least in part be blocked.

A number of devices have been suggested for storage of brushes within paint tins to reduce the burden of cleaning and some of these suggestions are to hold the brush by using the lid. The closest known prior art to the present invention is disclosed in Australian patent specification AU12242/92 in the name of Azoulay. The disclosure of this document relates to a storage container lid with an aperture therethrough so that the handle is gripped within an upwardly extending collar by a resilient insert which can close around the handle of the paint brush. The arrangement of the Azoulay disclosure requires a number of parts which need assembly and is consequently relatively complex in operation and construction.

OBJECT OF THE INVENTION

It is an object of the present invention to provide a holder for a paint brush or other painting implement that obviates the need to wash a paint brush after every use of the paint brush and that obviates or minimises any one of the above problems or at least provides the public with a useful choice.

SUMMARY OF THE INVENTION

In a broad form, but not necessarily the broadest or only form, the invention could be said to reside in a container lid including, a container engaging periphery, a lid web extending between the periphery for closure of a fluid containing container, an handle receiving aperture through the lid web and a gripping means disposed upwardly of the aperture to grip the handle of a painting implement, the implement gripping means comprising two opposed walls extending upwardly of the lid web, and sides holding the walls in a substantially fixed position relative to one another, the opposed walls resiliently flexible and spaced apart to an extent to exert a clamping effect on the handle.

It is preferred that the lid is integrally formed, and preferably of a plastics material, to minimise the complexity of the container lid and to simplify the manufacture of the container lid. The integral formation might thus be by reason of a moulding in plastics generally from one type of plastics Preferably the handle gripping means has no aperture therein so that it covers the aperture completely and so that there is no exchange of air to the outside of the lid. That will minimise the extent to which any fluid within the container evaporates and also has the added benefit in case the container is knocked over that the paint inside will not spill. In this form the gripping means provides a surface extending upwardly from the web of the lid, which in addition to gripping the handle of the painting implement also acts as a handle for a user to grasp where desired. The user will grasp the upstanding gripping means from the outside, with the handle of the painting implement being clamped on the inside.

Preferably the sides of the gripping means are tapered upwardly so that several of the lids can be stacked on top of one another.

In one form the opposing walls converge upwardly, so that there is a diminishing distance between the two opposing flat surfaces, which in addition to aiding stacking might also better accommodate varying thicknesses of painting implements.

In preference the opposed walls are spaced apart to an extent that when inserted, the handle urges a portion of each of said opposed walls apart so that the opposed walls exerts a clamping effect on the handle. It is found that generally there will be sufficient clamping pressure on the handle of the painting implement by the opposed walls, however, it may be desirable to supplement the clamping pressure that is exerted by the opposed wall by providing clamp means to apply a clamping pressure to the outside of the opposed walls to supplement the clamping pressure thereon.

Alternatively the opposed side walls might not exert any clamping pressure and all of the pressure is provided by clamping means which apply a clamping pressure to the outside of the opposed walls.

BRIEF DESCRIPTION OF THE DRAWINGS

For a better understanding, the invention will now be described with reference to an illustrated embodiment wherein.

Similar reference characters indicate corresponding parts throughout the several views of the drawings.

Figure 1:
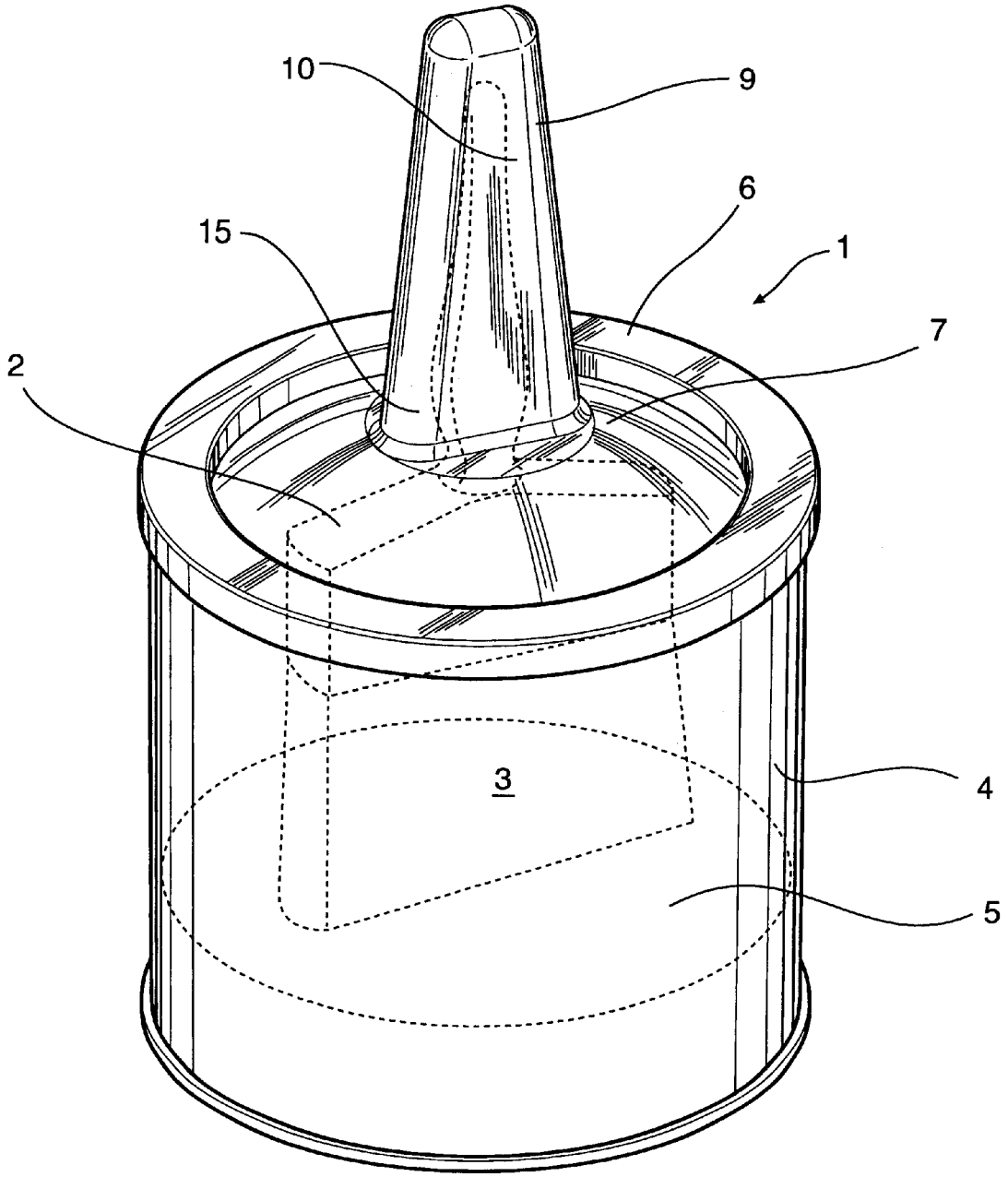
FIG. 1 is a perspective view of a paintbrush (shown in broken lines) stored within the lid of a paint container, held within the gripping means of the lid.

Dimensions of certain of the parts as shown in the drawings may have been modified and/or exaggerated for the purposes of clarity of illustration.

The illustrated embodiment shows a container lid (1) for holding a painting implement such as a paint blush (2) with the bristles (3) positioned downwardly so as to be located within a container (4) for which the lid is suited. This is a suitable arrangement for the bristles to contact or be held above a liquid (5) which might be paint.

The container lid includes a container engaging periphery (6) which engages onto the periphery of the container. A lid web (7) extends within the periphery of the lid and closes the container apart from a handle receiving aperture (8) through the lid web. A gripping means (9) is disposed upwardly of the aperture and comprises two opposed walls (10, 11) which are spaced apart to an extent so as to be capable of exerting a clamping effect on the handle (12) of a painting implement, in this case a paint brush.

Figure 6A:
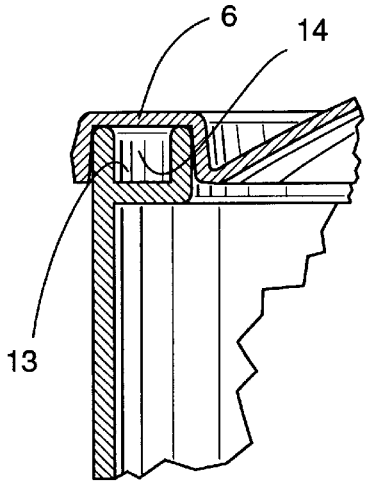
FIG. 6*a* is a close-up partial radial cross sectional view of a first embodiment of the container engaging periphery of the lid.
Figure 6B:
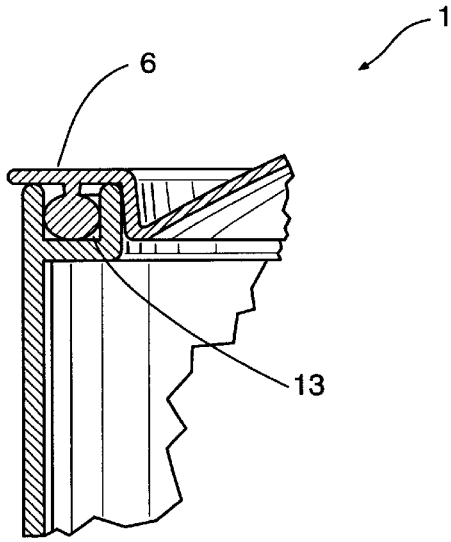
FIG. 6*b* is a close-up partial radial cross sectional view of a first embodiment of the container engaging periphery of the lid.

In this particular embodiment the container lid is capable of fitting a standard sized paint can, perhaps of four liter or one liter capacity, and the container lid can be used to substitute for the lid that comes with the paint can when purchased. The container lid of this embodiment is made of plastics, examples of suitable plastics being polypropylenes and polyethylenes. The container engaging periphery (6) instead of having a bead that normally engages the groove (13) of the container periphery, has a larger inverted groove (14) into which a periphery of a standard size paint container can fit. The inverted groove of the lid is made to be slightly undersized so that it can snap fit over the paint can periphery, this is illustrated in more detail in FIG. 6*a*. It will be understood that different configurations of container engaging periphery (6) may also be used, such as one that has a bead (14*a*) to mimic the standard paint can lid, which can then be snap fitted into the groove (13) such as shown in FIG. 6*b*, or alternatively one that has a simple flange on the outside that fits tightly around the outside of the can to thereby engage the paint container. The presently illustrated arrangement is however preferred because there are two surfaces of frictional contact within groove (14) to provide a tighter grip, and additionally whereas the conventional paint can lid is made of metal and pressing down on the lid to have its bead engage with the paint can groove (13), perhaps even with a hammer, does not severely adversely affect that lid, striking with a hammer is very likely to affect the integrity of a plastics container lid.

Figure 3:
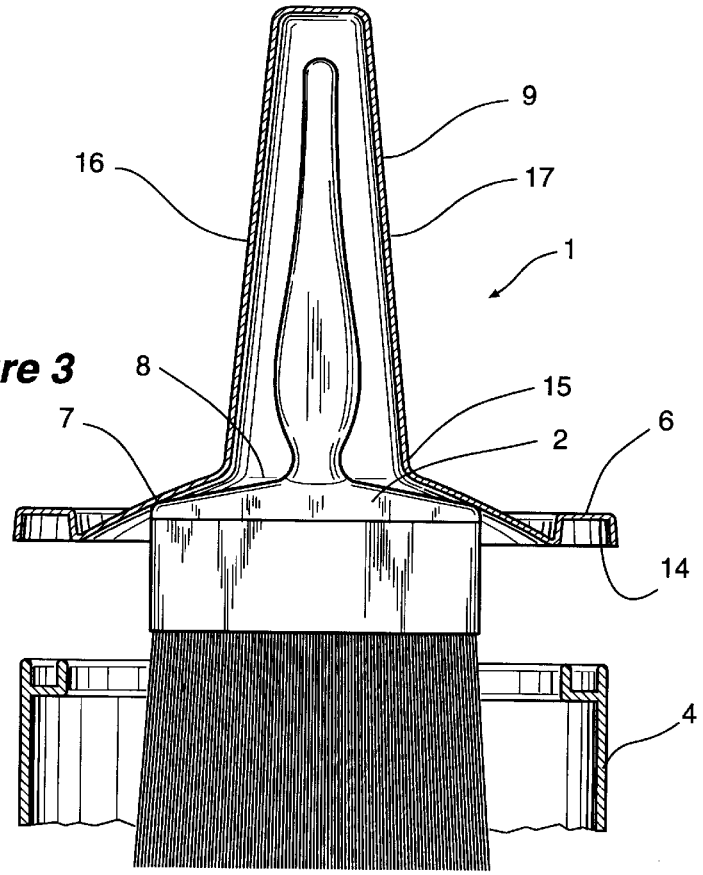
FIG. 3 is a side view of the paintbrush held within the lid of the container and a cross sectional view of part of the container and the lid shown in cross section through III—III of FIG. 2
Figure 4:
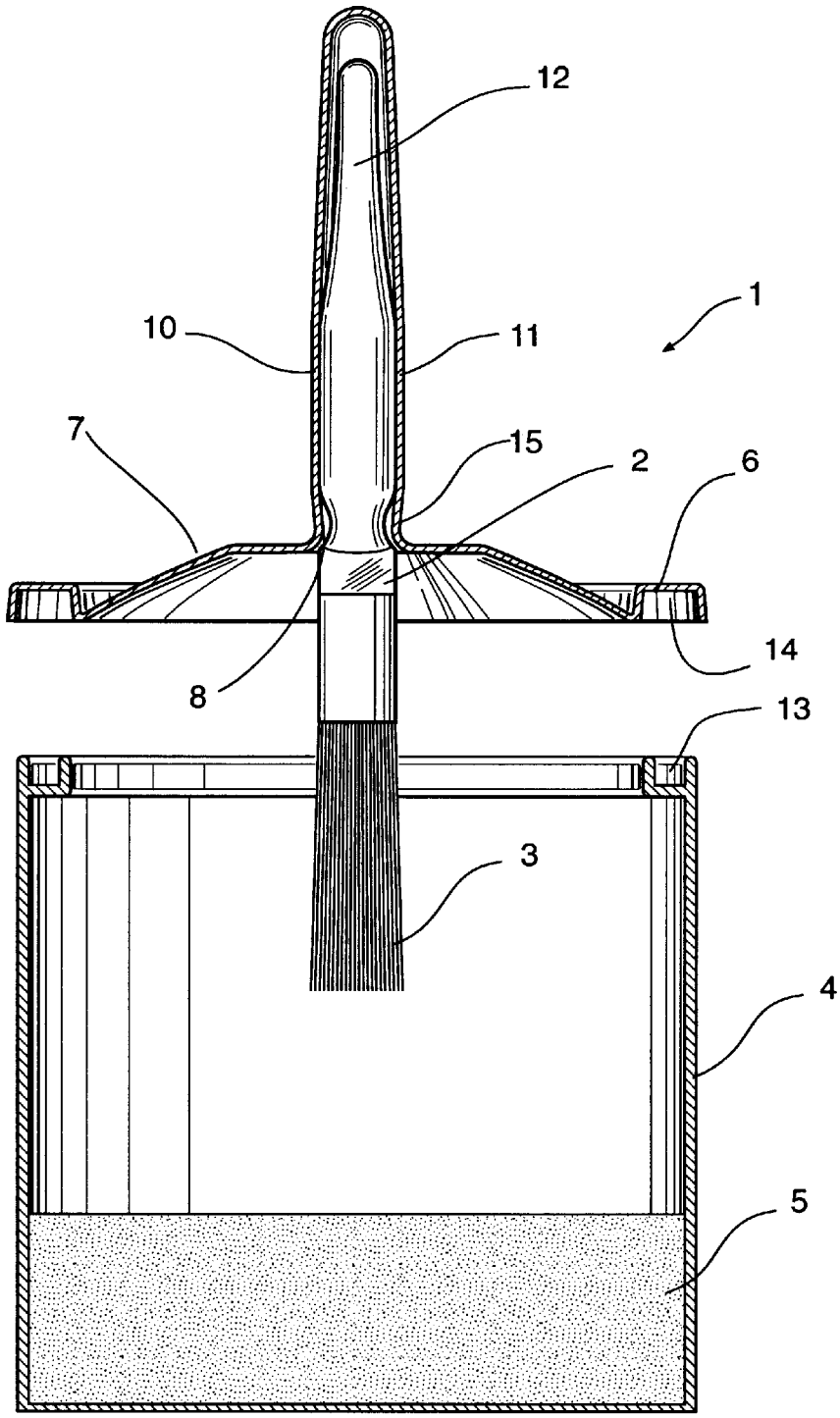
FIG. 4 is a cross sectional view of the paint brush holder held within the lid of the container through IV—IV of FIG. 2
Figure 5:
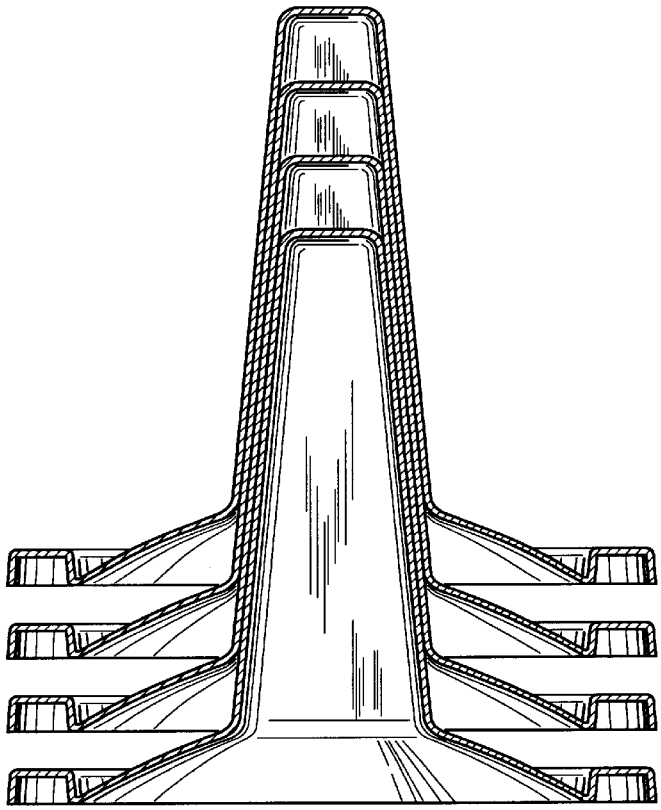
FIG. 5 is a cross sectional view of a stack of lids, with a cross section similar to the cross sectional view shown in FIG. 3, showing the manner in which the lids can be nested together.

The side profile of the lid web (7) can perhaps best be seen in FIGS. 3 and 4. It can be seen that the lid web is raised towards the centre. This contributes somewhat to the strength of the container lid, and additionally accommodates the paint brush in a higher position relative to the container.

Figure 2:
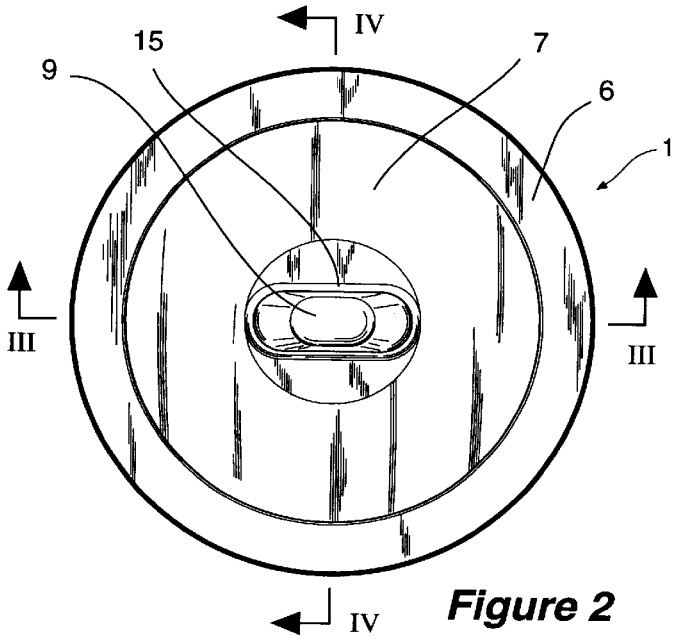
FIG. 2 is a plan view from the top looking down onto the container lid.

The cross sectional dimension of a base (15) of handle receiving aperture (8) is best seen in FIG. 2, with the shape of the side walls best appreciated from FIG. 3 and the extent to which opposed walls are spaced apart is best appreciated from FIG. 4. It is found that for many paint brushes that might be used by painters the handles only have very small variation in thickness. It is found that one configuration can be used for the majority of paint brushes. Of course that does not mean that other configurations of handle receiving apertures and gripping means might not be provided for different types of brushes, or indeed for other painting implements such as paint rollers, or indeed for other applicators of liquids such as adhesives or the like where a drying has an adverse effect on the applicator and where cleaning has the same disadvantages as for paint brushes. Provision for paintbrushes with handles of cross-sectional dimension varying from the norm can be accommodated in variations to the invention and this will be discussed below.

In the illustrated embodiment the two opposed walls are substantially parallel extending upwardly from the lid web (7) and held apart by two side walls (16, 17) and are closed off at the top. The extent to which the walls are spaced apart is less than the thickness of the handle of a standard tradesman's brush. The thickness of the opposed walls is about 1 mm, and the brush handle can be pushed through the handle receiving aperture such that the two opposed walls (10, 11) are forced apart. In the illustrated embodiment the opposed walls may be forced apart a collective further 3 mm by the handle of a tradesman's brush or more if the handle is thicker. The side walls (16, 17) are relatively rigid in part by reason of their arcuate horizontal cross section additionally they can also be made of thicker plastics so as to be more rigid. The rigidity of the side walls impacts on the capacity of the opposed wall to exert the clamping effect on the handle of the side wall by enhancing the capacity of the opposite walls to clamp to the sides of the handle and maintain the paint brush in position, suspended within the container.

A variety of plastics might be used for the container lid, and their properties in terms of flexure and rigidity will vary, and the extent to which the two opposed walls are spaced apart may depend on the plastics that are used. It is intended however that the plastics is sufficiently rigid so that the weight of the paint brush does not collapse the gripping means downwardly, a very pliable rubber will not suffice. Other polymeric material may also be suitable, such as resinous material, for example a thin fibreglass may also be adequate. A great deal of flexure is not required or desirable.

It may also be desirable to have features within the inside of the two opposed walls to enhance the clamping effect. Thus vertically aligned ridges may be desirable to provide a better grip, whilst still permitting easy moulding, although where the lid is blow moulded, or vacuum formed horizontal aligned ridges may also be formed.

It may also be desirable to have means to further enhance the clamping effect, and thus it may be desirable to have a clamp means, which can be clamped onto the outside of the two opposed walls to thereby urge a lower portion of the two opposed walls together. The clamp means may take the form of a U shaped clip, which is slid into place close to the base of the gripping means, so that whilst the two opposed walls are distended by contact of the handle of the paint brush the two opposed walls are clamped together lower down to further inhibit the paint brush from dropping down. The clip may be integrally formed with the container lid, and when moulded and may simply extend from, for example the periphery of the container lid, and can be cut or snapped off when needed.

The configuration of the two opposed wall may be such that they themselves do not have a clamping effect on the handle of a paint brush, but the clamping means or clip described in the above paragraph may by exerting its clamping effect be the sole means by which the brush is held in place.

It is found that it is not necessary for the bristles of a paint brush to contact the paint directly to give beneficial effects. The times for storage of a paint brush which has been used for painting can be greatly extended even if suspended over paint in a sealed container. The inventor has conducted experiments and found that even after an extended time the brush is still maintained in good condition where there is no such contact. For water based paints a brush has been maintained for up to six months and for oil based paints a brush has been maintained for up to one week. It is accordingly desirable to have the brush held in a position that is relatively high up in the paint container, because what is undesirable is that there is too much contact with the paint, and if the can is relatively full then there will be excessive contact which will diminish the useability of the brush after such storage.

Figure 7:
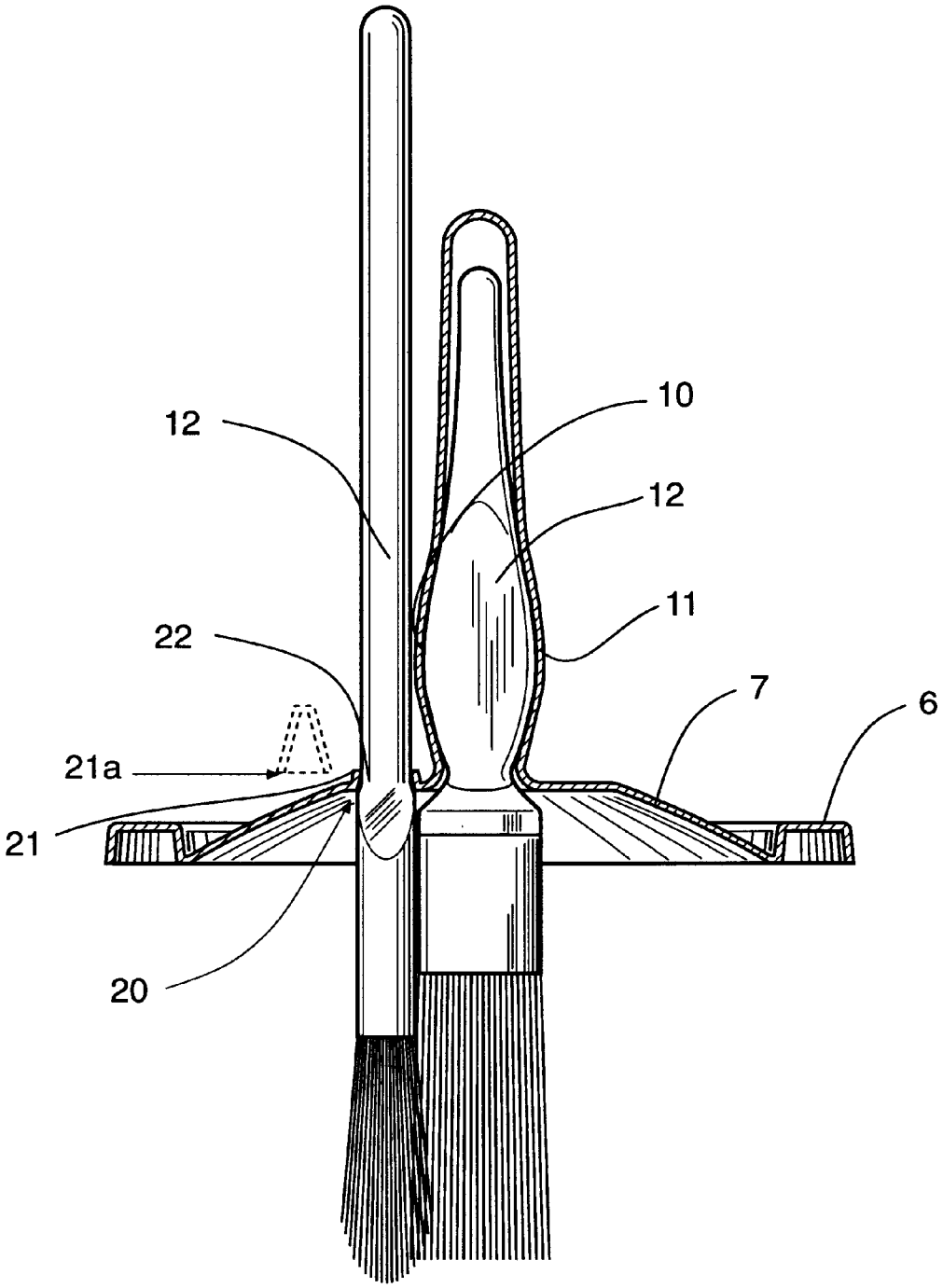
FIG. 7 is a cross section of a lid showing carriage of both a cutting brush and another smaller paint brush in a second embodiment of a lid according to this invention.

A second embodiment of the invention shown in FIG. 7 shows the manner in which the invention can be adapted to hold brushes with varying dimensions of handles (12). A cutting brush (20) typically has a handle (12) that is circular in cross section. A cutting brush holding means (21) is provided for in the lid by forming a hollow conical protrusion. The conical protrusion can be cut at a height (indicated at 21*a*) to leave a cutting brush aperture (22) with a dimension suitable to allow for frictional engagement with the cutting brush handle. The cut off portion is shown in broken outline in FIG. 7. It will be appreciated that the height of the cut can be varied to suit the transverse dimension of the cutting brush. It can be seen that typically a small upright collar (23) will be left, which is somewhat flexible and provides an extra gripping effect. The cutting brush aperture is spaced apart from the handle receiving aperture (8) so that two brushes can be held at the same time, one in the handle receiving aperture (8) and the other in the cutting brush aperture (22). FIG. 7 shows a brush with smaller cross sectional dimension than might normally be contemplated to be held by the gripping means, but which is still somewhat elongate in transverse cross section. Instead of being inserted so the elongate cross section of the handle (12) is aligned with elongate dimensions of the gripping means, the paint brush handle is inserted at right angle thereto so that the two opposing walls (10, 11) can be engaged by the narrower sides of the handle. This then enables engagement of smaller brushes by the gripping means. It can be seen that the opposing wall are flexed to a greater degree in FIG. 7, however, there is less surface contact with the handle than the paint brush shown in FIG. 4.

What is claimed is:

1. An integrally formed plastics container lid for closure of a standard paint container in place of an original lid, said container lid including, a container engaging periphery, said periphery including container engaging means having an inverted groove into which the periphery of the standard paint container can fit, the inverted groove being undersized with respect to the container periphery so that it can snap fit over the periphery to effect an interference fit with the container when fitted thereto, a lid web extending between the periphery, a handle receiving aperture extending through the lid web and an implement gripping means disposed upwardly of the aperture, the implement gripping means totally enclosing a handle and comprising two opposed walls extending upwardly of the lid web, and sides holding the walls in a substantially fixed position relative to one another, the opposed walls being resiliently flexible and spaced apart to an extent to exert a clamping effect on a handle positioned through the handle receiving aperture, said implement gripping means tapered upwardly so the implement gripping means can be positioned through a handle receiving aperture and fitted into an implement gripping means of another equivalent container lid so that container lids can be stacked one partly within the other.

2. A container lid as in claim 1 wherein the opposed walls are spaced apart to an extent that when inserted, the handle urges a portion of each of said opposed walls apart to thereby exert the clamping effect on the handle.

3. A container lid as in claim 2 wherein the opposing walls converge upwardly, so that there is a diminishing distance between the two opposing flat surfaces so that the implement gripping means can accommodate handles of varying thicknesses.

4. A container lid as in claim 3 wherein the opposing walls are tapered upwardly.

5. A container lid as in claim 4 wherein the opposing walls are provided with opposing substantially flat surfaces for exerting the clamping effect.

6. A container lid as in claim 1 wherein the lid web is raised in side profile towards the aperture.

* * * * *